US010718509B2

(12) United States Patent
Taddei et al.

(10) Patent No.: US 10,718,509 B2
(45) Date of Patent: Jul. 21, 2020

(54) LIGHT FIXTURE AND DIRECTIONAL ASSISTIVE LISTENING DEVICE

(71) Applicant: Sonear, LLC, Roscoe, IL (US)

(72) Inventors: Steven Ronald Taddei, Rockford, IL (US); David Wayne Powell, Roscoe, IL (US)

(73) Assignee: SONEAR, LLC, Roscoe, IL (US)

( * ) Notice: Subject to any disclaimer, the term of this patent is extended or adjusted under 35 U.S.C. 154(b) by 0 days.

(21) Appl. No.: 16/150,014

(22) Filed: Oct. 2, 2018

(65) Prior Publication Data

US 2019/0101279 A1 Apr. 4, 2019

Related U.S. Application Data

(60) Provisional application No. 62/567,074, filed on Oct. 2, 2017.

(51) Int. Cl.

| | |
|---|---|
| ***F21V 33/00*** | (2006.01) |
| ***F21V 23/04*** | (2006.01) |
| ***F21S 6/00*** | (2006.01) |
| ***H04R 1/02*** | (2006.01) |
| ***F21V 1/00*** | (2006.01) |
| ***F21V 17/04*** | (2006.01) |
| ***H04R 3/00*** | (2006.01) |

(52) U.S. Cl.

CPC ..... *F21V 33/0056* (2013.01); *F21S 6/005* (2013.01); *F21V 1/00* (2013.01); *F21V 17/04* (2013.01); *F21V 23/04* (2013.01); *H04R 1/028* (2013.01); *H04R 3/00* (2013.01); *H04R 2420/07* (2013.01)

(58) Field of Classification Search

CPC ..... F21V 33/056; F21V 1/00; F21V 17/04; F21V 23/04; F21S 6/005; H04R 1/028; H04R 3/00; H04R 2420/07

See application file for complete search history.

(56) References Cited

U.S. PATENT DOCUMENTS

| | | | | |
|---|---|---|---|---|
| 5,655,833 | A * | 8/1997 | Raczynski | F21S 6/002 248/125.3 |
| 7,758,234 | B1 * | 7/2010 | Savicki, Jr. | H01R 13/652 362/641 |
| 10,244,597 | B1 * | 3/2019 | Scott | H04R 1/04 |
| 2003/0222588 | A1 * | 12/2003 | Myron | H05B 37/0227 315/159 |

(Continued)

*Primary Examiner* — Mary Ellen Bowman

(57) ABSTRACT

A light fixture and directional assistive listening device includes a portable lamp fixture, a parabolic sound membrane, and a light and acoustic transducer assembly. The portable lamp fixture includes a stand, a light socket, and a primary power cord. The primary power cord is electrically connected to the light socket through the stand. The parabolic sound membrane is concentrically attached to the light socket. The light and acoustic transducer assembly is electrically connected to the light socket and concentrically positioned within the parabolic sound membrane. When the light and acoustic transducer assembly is communicably coupled with an external audio device, the light and acoustic transducer is able to output greater clarity of speech and directionality of sound due to the configuration and positioning of the light and acoustic transducer assembly and the parabolic sound membrane.

10 Claims, 7 Drawing Sheets

(56) References Cited

U.S. PATENT DOCUMENTS

| | | | | |
|---|---|---|---|---|
| 2006/0077672 | A1* | 4/2006 | Schaak | F21S 6/003 362/418 |
| 2007/0064433 | A1* | 3/2007 | Wright | F21V 33/0056 362/364 |
| 2008/0298045 | A1* | 12/2008 | Wright | F21V 33/0056 362/86 |
| 2009/0010477 | A1* | 1/2009 | Frobisher | F21V 33/0056 381/386 |
| 2009/0196016 | A1* | 8/2009 | Massara | F21V 23/0471 362/86 |
| 2017/0311062 | A1* | 10/2017 | Garrett | H05B 33/0872 |

* cited by examiner

LIGHT FIXTURE AND DIRECTIONAL ASSISTIVE LISTENING DEVICE

The current application claims a priority to the U.S. Provisional Patent application Ser. No. 62/567,074 filed on Oct. 2, 2017.

FIELD OF THE INVENTION

The present invention relates generally to lighting fixtures and audio devices. More specifically, the present invention relates to a directional assistive listening device that is integrated into a light fixture thus providing audio output and lumen output.

BACKGROUND OF THE INVENTION

Audio systems come in various sizes and designs. In general, audio systems comprise a number of speakers and a control device. The control device generally comprises a number of audio inputs, a number of audio outputs, a control circuit, a user interface, a power system, and various electronic components. Recently, newer audio systems allow the user to wirelessly transmit audio files to be played on the audio device. Some audio systems have some components which have been integrated with furniture or decorative objects to make them part of the room's ornamental design. Now, most of the currently available audio systems with components integrated into furniture or decorative objects are positioned inside the body of the furniture or decorative object and the individual components of the audio devices do not form part of the body of the furniture or decorative object. In addition, most of the currently available audio systems with components integrated into a furniture or decorative object do not provide directional sound waves to provide a single user, or users, within a listening zone with an audio feed which only the single user, or users, can hear. Furthermore, most of the currently available audio systems with components integrated into furniture or decorative objects are not integrated into light fixtures in a low-profile way. Thus, a personal assistive listening device which is attached into a light fixture with components forming part of the body of the light fixture and provides a personal audio feed to a user is beneficial and necessary.

An objective of the present invention is to provide a directional assistive listening device which provides a single audio feed to a user, or users, who are located within a specific listening zone. Another objective of the present invention is to provide a personal assistive listening device which is integrated into a light fixture. Another objective of the present invention is to provide a personal assistive listening device with components which may form part of the body of the light fixture. Another objective of the present invention is to provide a personal assistive listening device which is wireless. Another objective of the present invention is to provide a directional assistive listening device which works together with the lights of the light fixture. Additional advantages of the present invention are set forth in part in the description which follows, and in part will be obvious from the description, or may be learned by practice of the present invention. Additional advantages of the present invention may be realized and attained by means of the instrumentalities and combinations particularly pointed out in the detailed description of the present invention section. Further benefits and advantages of the embodiments of the present invention becomes apparent from consideration of the following detailed description given with reference to the accompanying drawings, which specify and show preferred embodiments of the present invention.

DETAIL DESCRIPTIONS OF THE INVENTION

All illustrations of the drawings are for the purpose of describing selected versions of the present invention and are not intended to limit the scope of the present invention.

The present invention is a light fixture and directional assistive listening device, wherein a personal assistive listening device is integrated or positioned within a light fixture. The present invention is designed to both aesthetically and functionally integrate in household environment or business environment usage. The present invention wirelessly connects with a source that can include a smartphone, electronic tablet, audio receiver, television, or computer so that audio signal (audio files) from those electronic devices can be wirelessly transmitted and outputted through the present invention.

Figure 1:
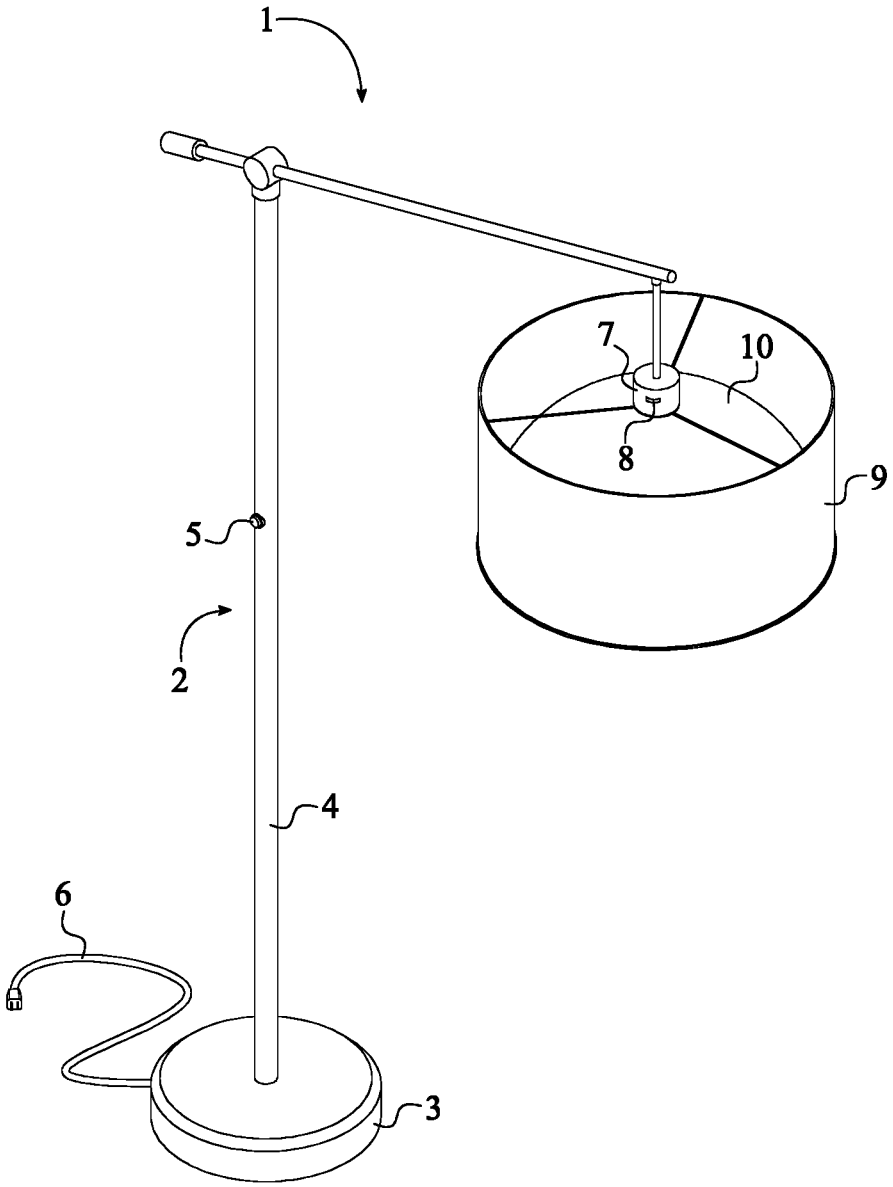
FIG. 1 is a top perspective view of the present invention, showing the power outlet of the light socket.
Figure 2:
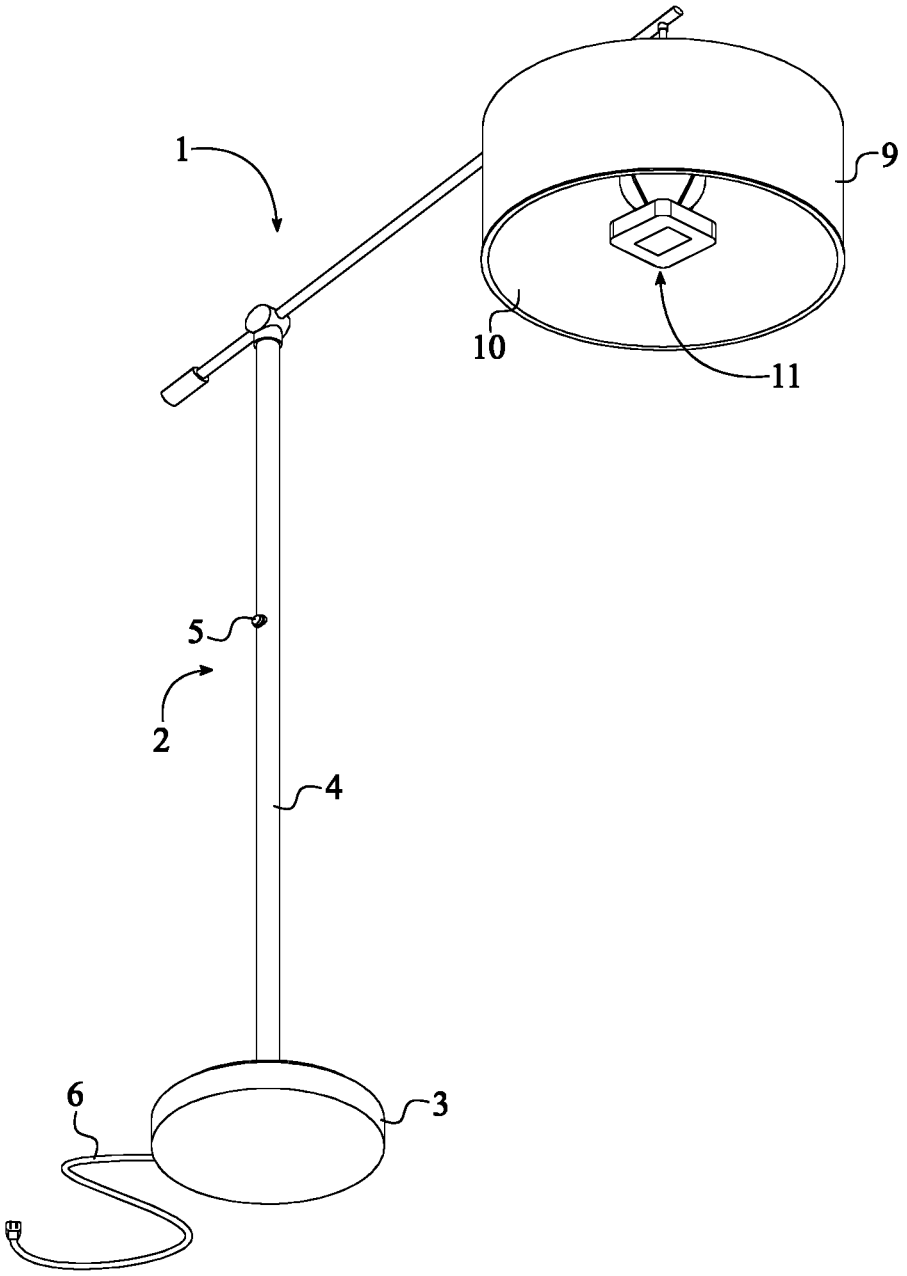
FIG. 2 is a bottom perspective view of the present invention, showing the light and acoustic transducer assembly.

The present invention comprises a portable lamp fixture 1, a parabolic sound membrane 10, a light and acoustic transducer assembly 11 as shown in FIG. 1-2. The portable lamp fixture 1 comprises a stand 2, a light socket 7, and a primary power cord 6 as shown in FIG. 1-2. In reference to the general configuration of the present invention, the primary power cord 6 is electrically connected to the light socket 7 through the stand 2 similar to existing lamp fixtures. As a result, when the primary power cord 6 is connected to an external power outlet 8, the primary power cord 6 is able to electrically power the light socket 7 within the present invention. The parabolic sound membrane 10 improves both the directional and sound quality of the outputted audio files and concentrically attaches to the light socket 7. As a result, the parabolic sound membrane 10 and the light socket 7 hang vertically from the stand 2. The light and acoustic transducer assembly 11 functions as an illuminating body in addition to amplifying the received audio signal and converting the received audio signal to acoustic energy. The light and acoustic transducer assembly 11 is electrically connected to the light socket 7 so that the light socket 7 can provide electrical power to the functionality and operation of the light and acoustic transducer assembly 11. In order to optimize the sound quality of the outputted audio files, the light and acoustic transducer assembly 11 is concentrically positioned within the parabolic sound membrane 10 so that the outputted sound emits up towards an apex of the parabolic sound membrane 10. The structural attachment between the light and acoustic transducer assembly 11 and the portable lamp fixture 1 depends upon different embodiments of the light and acoustic transducer assembly 11, which are explained in relation to a first embodiment and a second embodiment of the light and acoustic transducer assembly 11.

Figure 3:
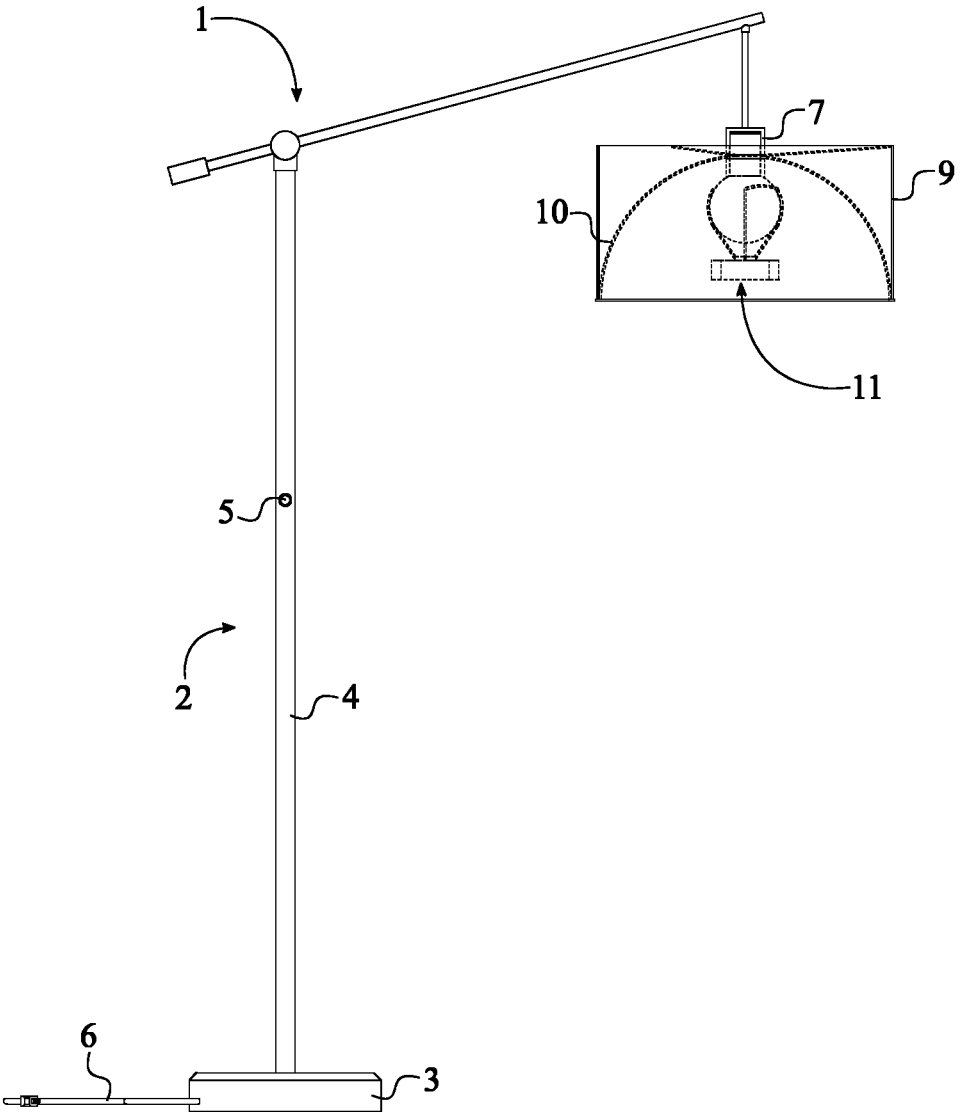
FIG. 3 is a side view of the present invention, wherein the dash lines illustrate internal components within the light diffuser.
Figure 8:
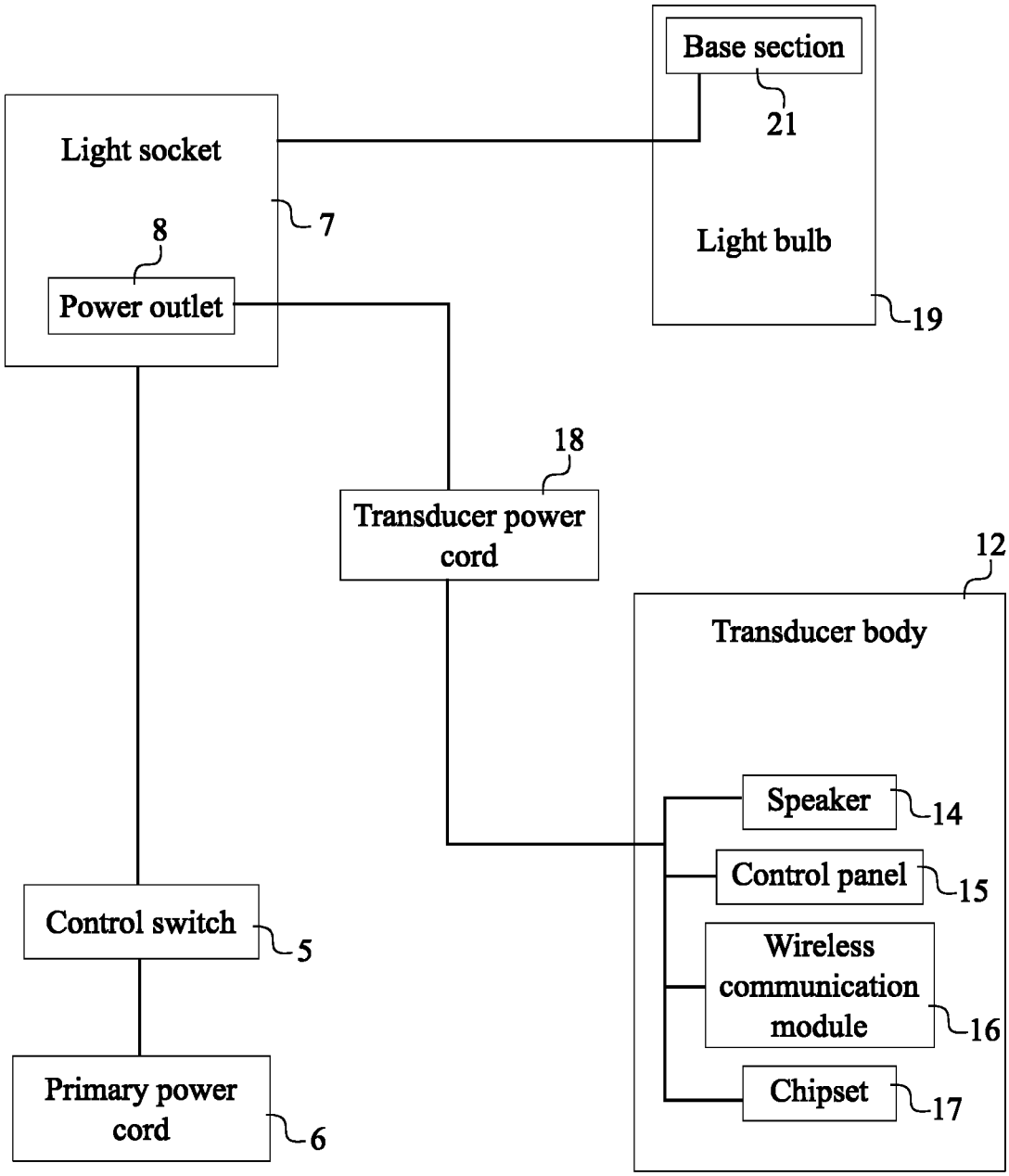
FIG. 8 is an electronic schematic showing the basic electrical connection for the first embodiment of the light and acoustic transducer assembly of the present invention.
Figure 9:
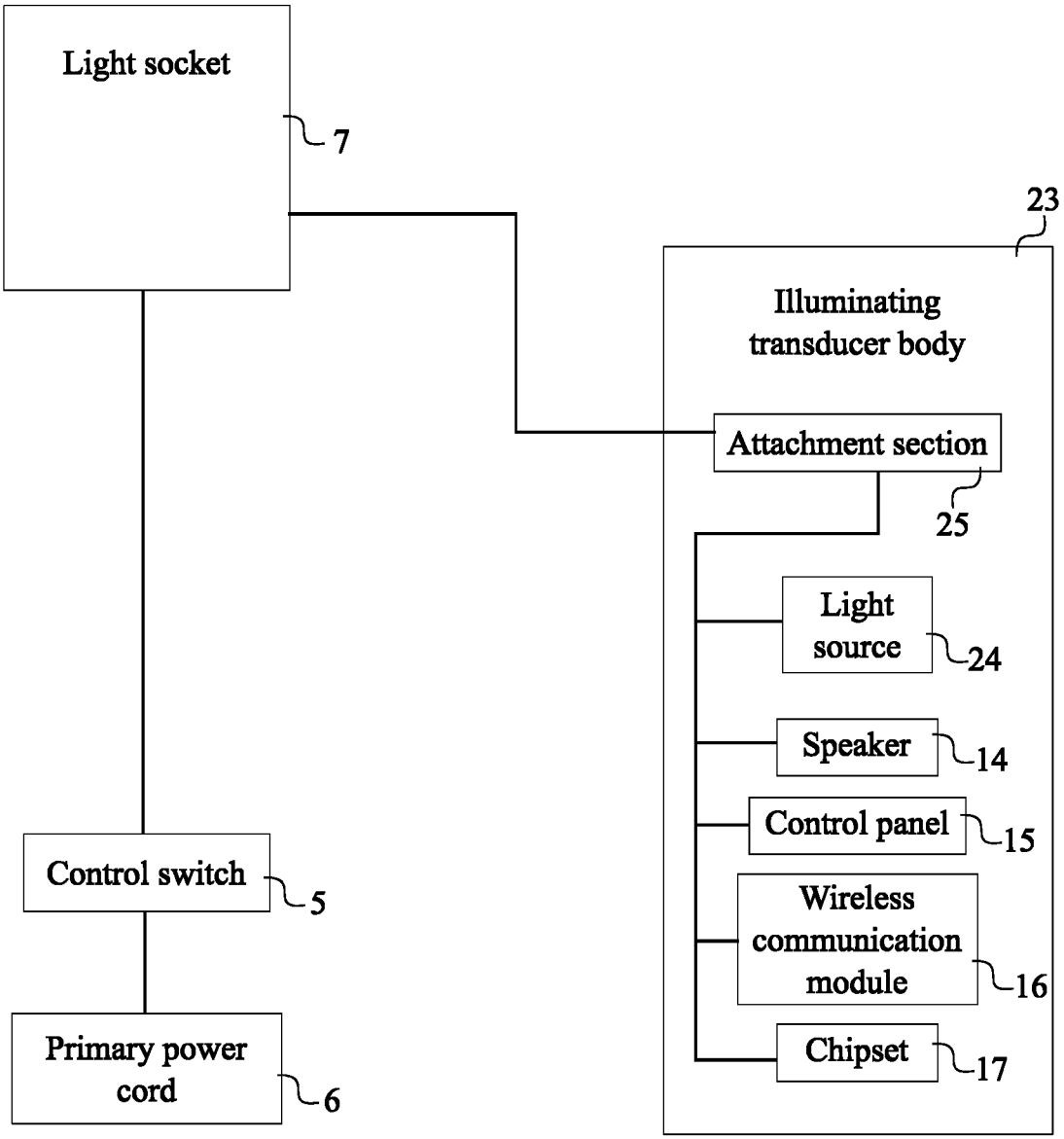
FIG. 9 is an electronic schematic showing the basic electrical connection for the second embodiment of the light and acoustic transducer assembly of the present invention.

The stand 2 functions as the structural member within the present invention so that the parabolic sound membrane 10 and the light and acoustic transducer assembly 11 can be elevated upon user's preferences, industry standards, or different types of portable lamp fixture 1*s*. For example, a stand 2 of a table lamp is shorter than a stand 2 of floor lamp due to the fact that the table lamp and the floor lamp are two different types of lamp fixtures. In reference to FIG. 1-3, the stand 2 comprises a base member 3, at least one extension member 4, and a control switch 5. More specifically, the at least one extension member 4 is terminally connected to the base member 3 from a free end of the at least one extension member 4. The light socket 7 is terminally connected to the at least one extension member 4 and positioned opposite of the base member 3. Depending upon different embodiment of the present invention, the at least one extension member 4 can be a single body or multiple bodies. For example, as shown in FIG. 3, the present invention shows a first extension body and a second extension body as the at least one extension member 4, wherein the first extension body and the second extension body are hingedly connected to each other opposite of the light socket 7 and the base member 3. The control switch 5 is electrically connected to the primary power cord 6 and the light socket 7 so that the control switch 5 can operate the illuminating body of the present invention as shown in FIG. 8-9. The control switch 5 is preferably integrated into the base member 3, the at least one extension member 4, or the light socket 7 depending upon different configurations of the portable lamp fixture 1 as long as the user is able to easily access the control switch 5. Furthermore, the control switch 5 can be an on/off dimmer switch thus enabling the control switch 5 to turn on, turn off, and control the brightness of the light within the illuminating body.

Figure 5:
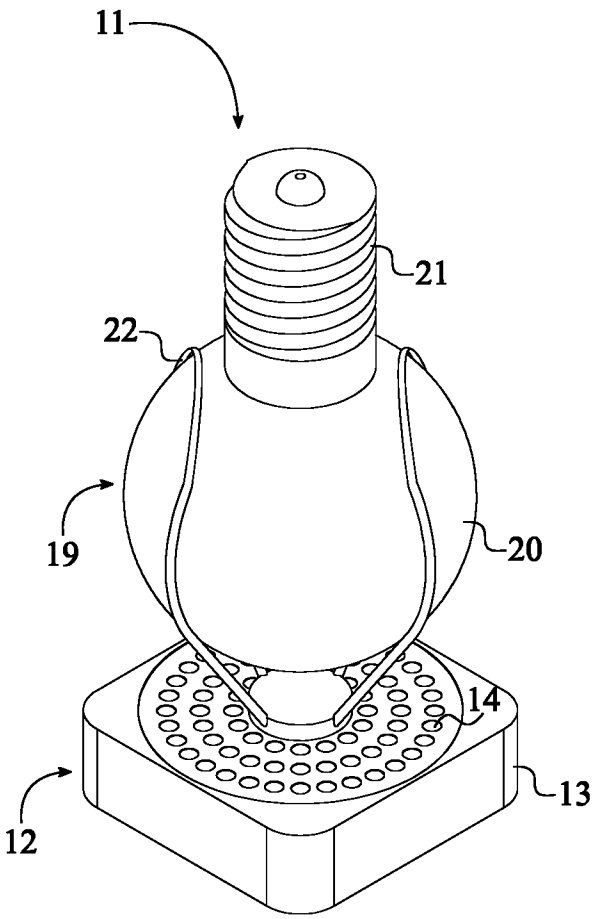
FIG. 5 is a top perspective view for the first embodiment of the light and acoustic transducer assembly of the present invention.
Figure 4:
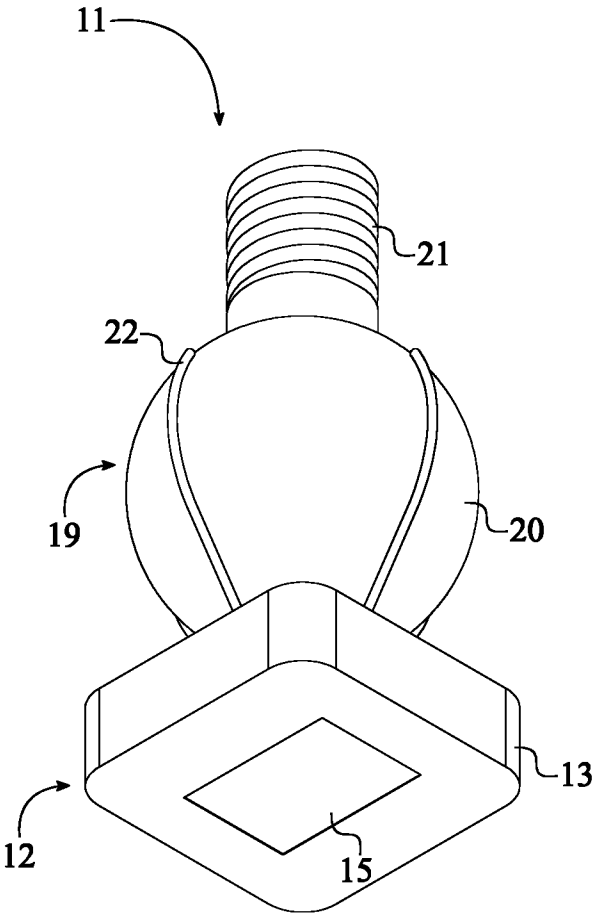
FIG. 4 is a bottom perspective view for the first embodiment of the light and acoustic transducer assembly of the present invention.

In reference to FIGS. 4-5 and FIG. 8, the first embodiment of the light and acoustic transducer assembly 11 comprises a transducer body 12, a light bulb 19, and an attachment mechanism 22. More specifically, the light bulb 19 functions as the illuminating body within the first embodiment. The attachment mechanism 22 that functions as the securing mechanism between the transducer body 12 and the light bulb 19 and is terminally connected to the transducer body 12. A base section 21 of the light bulb 19 is engaged within the light socket 7, wherein the base section 21 can be any type of light bulb 19 base such as E10, E11, E26, and E27. Due to the terminal connection, the base section 21 of the light bulb 19 is electrically connected to the light socket 7 as the electrical power is supplied to the light socket 7 through the primary power cord 6. The attachment mechanism 22 is terminally attached around a bulb section 20 of the light bulb 19 thus securing the transducer body 12 to the light bulb 19. The attachment mechanism 22 is preferably a pair of spring loaded arms so that the user is able to easily pull apart the pair of spring loaded arms into an opened option and gently release the pair of spring loaded arms onto the bulb section 20 of the light bulb 19. Resultantly, the pair of spring loaded arms is able to apply sufficient force against the bulb section 20 of the light bulb 19 thus securing the transducer body 12 to the light bulb 19. In order to power the transducer body 12, a transducer power cord 18 of the transducer body 12 is electrically connected to a power outlet 8 of the light socket 7. The power outlet 8 can include, but is not limited, USB port, coaxial power output, and NEMA-1 receptacle.

In reference to FIGS. 4-5 and FIG. 8, the transducer body 12 comprises a housing 13, a speaker 14, a control panel 15, a wireless communication module 16, and a chipset 17. The transducer body 12 is an acoustic transducer and is preferably a mid to high-frequency driver with a frequency response electro-acoustically designed to amplify and reproduce speech frequencies. More specifically, the speaker 14 that emits the audio files is integrated into the housing 13 and oriented towards the parabolic sound membrane 10. The control panel 15 is integrated into the housing 13 and allows the user to control turn on/off the transducer body 12, control the volume, change settings, and any other related features. Furthermore, the control panel 15 can be a touchscreen interface or a manual button interface. The wireless communication module 16 is mounted within the housing 13 so that the wireless communication module 16 can be protected from outside elements. The wireless communication module 16 allows the present invention to wirelessly communicate with the smartphone, electronic tablet, audio receiver, television, or computer thus enabling the audio files from those electronic devices to be wirelessly transmitted and outputted through the speaker 14. The wireless communication module 16 can include networks such as a wireless network for short distance data exchanging, a wireless local area networking, or any other types of wireless networks. The attachment mechanism 22 is positioned adjacent to the speaker 14 so that the attachment mechanism 22 is able to orient the speaker 14 towards the light bulb 19 and the parabolic sound membrane 10. The chipset 17 is a set of electronic components in an integrated circuit and process input data of the transducer body 12. Similar to the wireless communication module 16, the chipset 17 is mounted within the housing 13 to protect from outside elements. The transducer power cord 18 traverses into the housing 13 and electrically connected to the speaker 14, the control panel 15, the wireless communication module 16, and the chipset 17. Due to the fact that the transducer power cord 18 is electrically connected to the power outlet 8 of the light socket 7, the transducer power cord 18 is able to provide electrical power to the speaker 14, the control panel 15, the wireless communication module 16, and the chipset 17.

Figure 7:
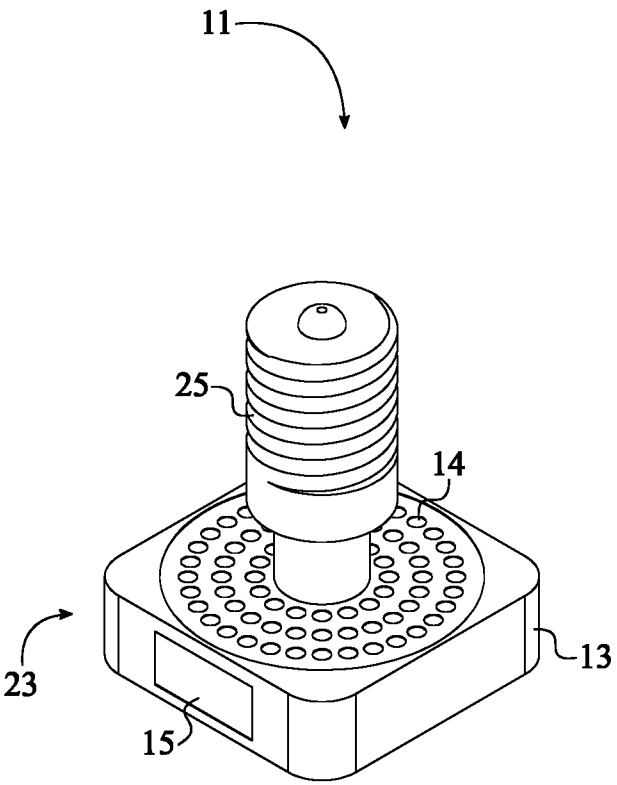
FIG. 7 is a top perspective view for the second embodiment of the light and acoustic transducer assembly of the present invention.
Figure 6:
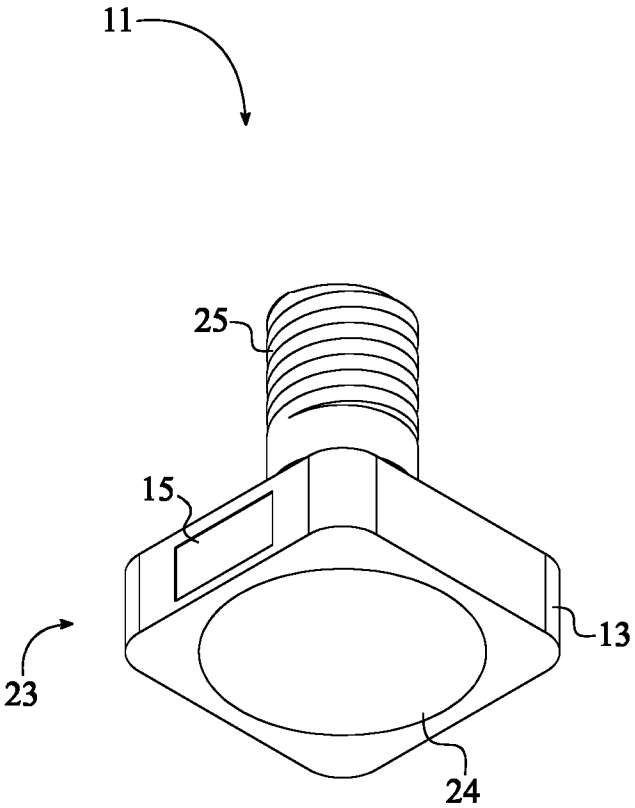
FIG. 6 is a bottom perspective view for the second embodiment of the light and acoustic transducer assembly of the present invention.

In reference to FIGS. 6-7 and FIG. 9, the second embodiment of the light and acoustic transducer assembly 11 comprises an illuminating transducer body 23 and an attachment section 25. More specifically, the attachment section 25 that functions as the securing mechanism and a power adaptor for the illuminating transducer body 23, wherein the attachment section 25 is terminally connected to the illuminating transducer body 23. The attachment section 25 is engaged within the light socket 7 thus securing the illuminating transducer body 23, wherein the attachment section 25 can be similar to any types of light bulb 19 base such as E10, E11, E26, and E27. The attachment section 25 is electrically connected to the light socket 7 and functions as the power adaptor for the illuminating transducer body 23 as the electrical power is supplied to the light socket 7 through the primary power cord 6. Resultantly, the attachment section 25 is able to electrically power the illuminating transducer body 23 within the second embodiment.

In reference to FIGS. 6-7 and FIG. 9, the illuminating transducer body 23 comprises a housing 13, a light source 24, a speaker 14, a control panel 15, a wireless communication module 16, and a chipset 17. The illuminating transducer body 23 is an acoustic transducer and is preferably a mid to high-frequency driver with a frequency response electro-acoustically designed to amplify and reproduce speech frequencies, along with the light source 24. More specifically, the light source 24 is integrated into the housing 13 and functions as the illuminating body within the second embodiment. The speaker 14 that emits the audio files is integrated into the housing 13 and oriented towards the parabolic sound membrane 10. Furthermore, the speaker 14 is oppositely positioned to the light source 24 so that the light source 24 is able to illuminate downward, towards the user, and the speaker 14 is able to emit audio upwards, towards the attachment section 25 and the parabolic sound membrane 10. The control panel 15 is integrated into the housing 13 and allows the user to control turn on/off the illuminating transducer body 23, control the volume, change settings, any other related features. Furthermore, the control panel 15 can be a touchscreen interface or a manual button interface. The wireless communication module 16 is mounted within the housing 13 so that the wireless communication module 16 can be protected from outside elements. The wireless communication module 16 allows the present invention to wirelessly communicate with the smartphone, electronic tablet, audio receiver, television, or computer thus enabling the audio files from those electronic devices to be wirelessly transmitted and outputted through the speaker 14. The attachment section 25 is positioned adjacent to the speaker 14 so that the attachment mechanism 22 is able to orient the speaker 14 towards the parabolic sound membrane 10. The chipset 17 is a set of electronic components in an integrated circuit and process input data of the transducer body 12. Similar to the wireless communication module 16, the chipset 17 is mounted within the housing 13 to protect from outside elements. The attachment section 25 is electrically connected to the light source 24, the speaker 14, the control panel 15, the wireless communication module 16, and the chipset 17. Due to the fact that the attachment section 25 is electrically connected to the light socket 7, the attachment section 25 is able to provide electrical power to the light socket 7, the speaker 14, the control panel 15, the wireless communication module 16, and the chipset 17.

In order to optimize the sound quality within the present invention, the light and acoustic transducer assembly 11 comprises a specific frequency response. More specifically, maintaining and amplifying speech frequencies for the light and acoustic transducer assembly 11 is within, but not limited to, 250 Hz to 6000 Hertz (Hz). As a result, the present invention is able to provide greater clarity of speech as opposed to amplifying bass and very high frequencies which can mask speech sounds. The amplification of speech frequencies within the range of 250 Hz to 6000 Hz can be accomplished by the following three different methods. First, the selection of different types of the light and acoustic transducer assemblies within the present invention can maintain the range of 250 Hz to 6000 Hz. More specifically, the transducer body 12 for the first embodiment of the light and acoustic transducer assembly 11 is designed to amplify the speech frequency range of 250 Hz to 6000 Hz. Similarly, the illuminating transducer body 23 for the second embodiment of the light and acoustic transducer assembly 11 is designed to amplify the speech frequency range of 250 Hz to 6000 Hz. Second, a baffle resonance of the light and acoustic transducer assemblies within the present invention can resonate, or reinforce, the range of 250 Hz to 6000 Hz. More specifically, the baffle resonance for the transducer body 12 for the first embodiment of the light and acoustic transducer assembly 11 is designed to amplify the speech frequency range of 250 Hz to 6000 Hz. Similarly, the baffle resonance for the illuminating transducer body 23 for the second embodiment of the light and acoustic transducer assembly 11 is designed to amplify the speech frequency range of 250 Hz to 6000 Hz. Third, a parabolic sound membrane 10 resonance can reinforce the range of 250 Hz to 6000 Hz. More specifically, the parabolic sound membrane 10 resonance in conjunction with the transducer body 12 for the first embodiment of the light and acoustic transducer assembly 11 is designed to amplify the speech frequency range of 250 Hz to 6000 Hz. Similarly, the parabolic sound membrane 10 resonance in conjunction with the illuminating transducer body 23 for the second embodiment of the light and acoustic transducer assembly 11 is designed to amplify the speech frequency range of 250 Hz to 6000 Hz.

Furthermore, a diameter of the parabolic sound membrane 10 is about 15 inches as the specific diameter keeps frequencies above 1800 Hz highly directional. Therefore, acoustic reflections emanating from the speaker 14 are focused outward having increased directionality for frequencies with wavelengths ½ the diameter of the parabolic sound membrane 10 thus remaining consistent with the speech frequencies range.

Furthermore, humans are unable to detect two separate sounds if they are less than 35 milliseconds apart. Therefore, in order to reduce any annoyance that the present invention may have from transmission latency or echo, the total transmission delay from the source to wireless communication module 16 and the wireless communication module 16 to speaker 14 as acoustic output preferably remains at or below 35 milliseconds.

In reference to FIG. 1-3, the present invention further comprises a light diffuser 9. The light diffuser 9 diffuses brightness of the illuminating body and functions as aesthetic feature within the present invention. The light diffuser 9 is concentrically positioned around the parabolic sound membrane 10 so that the light diffuser 9 can enclose the parabolic sound membrane 10. The light diffuser 9 may be attached to the light socket 7 or the parabolic sound membrane 10 as long as the light diffuser 9 does not interfere with the functionality of the parabolic sound membrane 10 and the light and acoustic transducer assembly 11.

The present invention may further comprise a wireless control device to allow the user to control the operation of the light and acoustic transducer assembly 11 remotely and wirelessly. The present invention may further comprise an electronic application which may be a mobile application, computer application, or similar application installed on a computing device which allows the user to control the operation of the light and acoustic transducer assembly 11 remotely and wirelessly. The present invention may come into different designs and sizes and may be made from a wide range of materials. The present invention may be retrofitted to existing light fixtures or manufactured into new light fixtures. In alternate embodiments of the present invention, the parabolic sound membrane 10 and the light and acoustic transducer assembly 11 can be housed within a different furniture pieces or decorative objects.

Although the invention has been explained in relation to its preferred embodiment, it is to be understood that many other possible modifications and variations can be made without departing from the spirit and scope of the invention as hereinafter claimed.

What is claimed is:

1. A light fixture and directional assistive listening device comprising:

a portable lamp fixture;

a parabolic sound membrane;

a light and acoustic transducer assembly;

a light diffuser;

the light diffuser being concentrically positioned around the parabolic sound membrane;

the portable lamp fixture comprising a stand, a light socket and a primary power cord;

the primary power cord being electrically connected to the light socket through the stand;

the parabolic sound membrane being concentrically attached to the light socket;

the light and acoustic transducer assembly being electrically connected to the light socket;

the light and acoustic transducer assembly being concentrically positioned within the parabolic sound membrane;

the light and acoustic transducer assembly comprising a transducer body, a light bulb and an attachment mechanism;

the attachment mechanism being terminally connected to the transducer body;

the light bulb comprising a base section and a bulb section;

the base section being engaged within the light socket;

the base section being electrically connected to the light socket;

the attachment mechanism being terminally attached around the bulb section;

the transducer body comprising a transducer power cord, a housing, a speaker, a control panel, a wireless communication module and a chipset;

the light socket comprising a power outlet;

the transducer power cord being electrically connected to the power outlet;

the speaker being integrated into the housing;

the speaker being oriented towards the parabolic sound membrane;

the control panel being integrated into the housing;

the wireless communication module being mounted within the housing;

the chipset being mounted within the housing;

the transducer power cord traversing into the housing;

the attachment mechanism being adjacently positioned to the speaker;

the transducer power cord being electrically connected to the speaker, the control panel, the wireless communication module and the chipset;

the attachment mechanism comprising two spring loaded arms;

the two spring loaded arms being connected to the housing;

each of the two spring loaded arms being attached around the bulb section; and each of the two spring loaded arms being biased against the bulb section so as to secure the housing to the bulb section.

2. The light fixture and directional assistive listening device as claimed in claim 1 comprising:

the stand comprising a base member, at least one extension member and a control switch;

the at least one extension member being terminally connected onto the base member;

the light socket being terminally connected to the at least one extension member, opposite of the base member; and the control switch being electrically connected to the primary power cord and the light socket.

3. The light fixture and directional assistive listening device as claimed in claim 2, wherein the control switch is an on/off dimmer switch.

4. The light fixture and directional assistive listening device as claimed in claim 2, wherein the control switch is integrated into the base member.

5. The light fixture and directional assistive listening device as claimed in claim 2, wherein the control switch is integrated into the at least one extension member.

6. The light fixture and directional assistive listening device as claimed in claim 2, wherein the control switch is integrated into the light socket.

7. The light fixture and directional assistive listening device as claimed in claim 1, wherein an amplifying speech frequencies range for the light and acoustic transducer assembly is within 250 Hz to 6000 Hz.

8. The light fixture and directional assistive listening device as claimed in claim 1, wherein the transducer body outputs an amplifying speech frequencies range within 250 Hz to 6000 Hz.

9. The light fixture and directional assistive listening device as claimed in claim 1, wherein a baffle resonance for the transducer body outputs an amplifying speech frequencies range within 250 Hz to 6000 Hz.

10. The light fixture and directional assistive listening device as claimed in claim 1, wherein a parabolic sound membrane resonance in conjunction with the transducer body outputs an amplifying speech frequencies range within 250 Hz to 6000 Hz.

* * * * *